United States Patent [19]

Gurian

[11] 4,325,469

[45] Apr. 20, 1982

[54] SOFT LUGGAGE CONSTRUCTION

[75] Inventor: Martin E. Gurian, Edgewater, N.J.

[73] Assignee: Burlington Industries, Inc., Greensboro, N.C.

[21] Appl. No.: 100,326

[22] Filed: Dec. 5, 1979

[51] Int. Cl.[3] ..... A45C 3/00

[52] U.S. Cl. ..... 190/53; 156/250; 428/246; 428/257; 428/258; 428/259; 428/284; 428/286; 428/913

[58] Field of Search ..... 156/224, 250, 278, 306.6; 428/246, 257, 258, 259, 284, 286, 913; 190/53

[56] References Cited

U.S. PATENT DOCUMENTS 3,309,451 3/1967 Holtzman ..... 428/246

4,061,817 12/1977 Maxel ..... 428/246

*Primary Examiner*—James J. Bell

*Attorney, Agent, or Firm*—Cushman, Darby & Cushman

[57] ABSTRACT

Pieces of soft luggage made from a particular fabric, and a method of making pieces of soft luggage using the fabric, and the particular fabric. The walls of the luggage are formed by a fabric which comprises a laminate including an outer layer, a lining layer, and a middle layer sandwiched between the outer lining layers. The outer layer comprises a fabric with a raised effect weave with the raised yarn of the weave a highly abrasion resistant yarn and the ground yarn a distinct spunlike yarn. The outer layer may be cross-dyed so that the raised and ground yarns are of different colors. The middle layer provides a water resistant barrier and provides a desired body and stiffness and dimensional stability to the laminate, and preferably is a solid film of polymeric material. The lining layer preferably comprises a fabric having textile-like hand, appearance and softness, such as NEXUS fabric.

24 Claims, 4 Drawing Figures

SOFT LUGGAGE CONSTRUCTION

BACKGROUND AND SUMMARY OF THE INVENTION

Traditionally soft luggage has been constructed of canvas fabrics, nylon, and vinyl. However such conventional fabrics have a number of properties that are not always considered desirable. For instance canvas can be adversely affected by rot or mildew, vinyl does not have textile appearance and hand, and regular nylon filament or highly abrasion resistant textured nylon results in flat, texture-less fabrics after conventional backcoating or lamination.

In order to provide a substitute for conventional soft luggage fabrics, recently soft luggage has been constructed of plain weave textured nylon fiber such as CORDURA. Soft luggage fabrics made of CORDURA are relatively lightweight while having a bulk superior to cotton, have significantly greater strength than cotton, have excellent abrasion resistance properties, and are not subject to rot or mildew. However, soft luggage of 100% plain weave CORDURA fabric, which may be back coated or film backed, while well suited for performing its ultimate function, has a flat, filament appearance (including luster) and hand, and does not always have optimum body or water-resistant barrier properties.

According to the present invention soft luggage is produced which eliminates the problems inherent in prior art soft luggage fabrics. The soft luggage according to the present invention has all the desirable characteristics of 100% CORDURA plain weave soft luggage or other highly abrasion resistant soft luggage, but additionally has improved appearance, body, texture, and water resistance. The fabric walls of the soft luggage according to the present invention have a textile-like appearance (including reduced luster) and hand, have good body, and include a water-resistant barrier. In general, the soft luggage according to the present invention is attractive, functional, tough, water repellent, and durable.

According to the present invention a piece of soft luggage having a plurality of fabric walls defining an interior volume is provided. The luggage includes means providing access to the interior volume and handle means for facilitating carrying of the piece of luggage. The fabric forming the walls comprises a laminate including an outer layer, a lining layer, and a middle layer sandwiched between the outer lining layers. The outer layer comprises a fabric with a raised effect weave with highly abrasion resistant yarn (e.g. CORDURA or the like) providing the raised yarn and the face thereof facing outwardly from the middle layer; and a distinct spun-like low luster yarn providing the ground yarn. The ground yarn preferably is spun polyester and the warp and filling yarns are of different color (although preferably complimentary colors). The middle layer may comprise a solid film of polymeric material capable of providing a suitable bond strength with the outer and lining layers, and the lining layer preferably comprises a dyed and overprinted suitable textile-like fabric, such as NEXUS. The construction of NEXUS fabric is fully described in U.S. Pat. No. 3,485,706, the disclosure of which is hereby incorporated by reference herein.

According to another aspect of the present invention a piece of soft luggage having a plurality of fabric walls defining an interior volume is provided. The luggage includes means providing access to the interior volume and handle means for facilitating carrying the piece of luggage. The fabric forming the walls comprises a fabric with a raised effect weave outer layer with the raised yarn facing outwardly of the interior volume, highly abrasion resistant yarn providing the raised yarn and a spun-like yarn, distinct from the warp yarn and which provides a textile-like aesthetics (i.e., appearance - including luster - and tactility) to the fabric, providing the filling yarn. The luggage wall fabric further comprises a lining, and means for attaching the outer layer and lining together while providing a water-resistant barrier and providing desired body and stiffness and dimensional stability. The warp ribbed fabric outer layer preferably comprises a warp faced twill weave having a $3_1 1_1$ construction, with the warp yarn having about a 1000 denier.

A fabric suitable for use in the construction of soft luggage or of the like according to the present invention consists essentially of the following: An outer layer of fabric comprising a raised effect, with the raised yarn being highly abrasion resistant yarn and the ground yarn being a spun-like yarn (preferably having a different color than the raised yarn). A lining layer comprising a textile-like fabric; and a middle layer comprising a solid film of polymeric material laminated between the outer and lining layers with the raised yarn facing outwardly from the middle layer, and with the middle layer providing a water-resistant barrier and desired body and laminate strength and dimensional stability.

The invention also contemplates a method of making a piece of soft luggage having fabric walls defining an interior volume. The method comprises the steps of: Weaving an outer fabric having a raised effect with the raised yarn being highly abrasion resistant yarn and the ground yarn being a spun-like yarn, distinct from the raised yarn, which provides textile-like aesthetics to the fabric. Forming a lining fabric. Laminating the outer fabric and the lining fabric together with a middle layer sandwiched therebetween so that the raised yarn of the outer fabric face away from the middle layer and so that the middle layer provides a water-resistant barrier and desired body and laminate stiffness and dimensional stability, to thereby produce a final fabric. Cutting the final fabric to form luggage walls. Forming the luggage walls into a piece of luggage defining an interior volume therein with the outer fabric exterior of the interior volume. Providing means for providing access to the interior volume in the luggage walls; and providing handle means to the piece of luggage to facilitate carrying thereof.

It is primary object of the present invention to provide attractive, tough, durable, and water-resistant soft luggage fabric walls having textile-like appearance and hand characteristics. This and other objects of the invention will become clear from an inspection of the detailed description of the invention and from the appended claims.

DETAILED DESCRIPTION OF THE DRAWINGS

Figure 1:
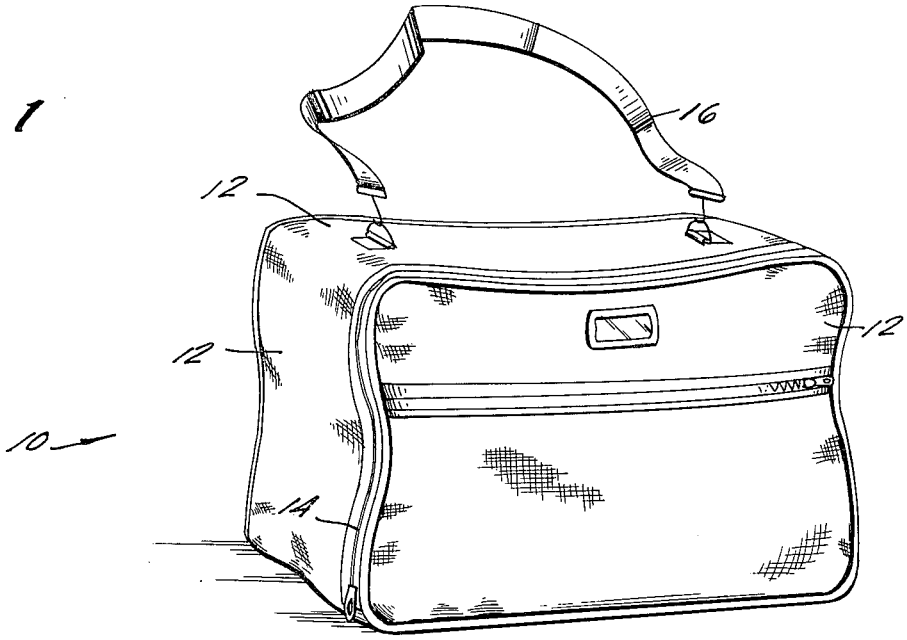
FIG. 1 is a perspective view of an exemplary piece of soft luggage according to the present invention.

A piece of soft luggage that may be constructed according to the present invention is illustrated generally at 10 in FIG. 1. The term "soft luggage" as used in the present specification and claims includes conventional soft sided luggage as illustrated in FIG. 1, back packs, tote bags, grips, duffle bags, pocketbooks, tennis bags, and the like. The piece of luggage 10 includes a plurality of highly abrasion resistant fabric walls 12 defining an interior volume; means for providing access to the interior volume such as the conventional zipper 14; and handle means for facilitating carrying of the piece of luggage 10, such as the conventional shoulder strap 16.

According to the present invention the fabric walls 12 of the piece of luggage 10 are constructed in a particular manner to provide fabric walls that are attractive yet tough, durable and water resistant, and having desirable textile-like aesthetics (i.e., appearance—including luster—and hand). An exemplary fabric according to the present invention is illustrated generally at 24 in FIG. 3 and comprises (and preferably consists essentially of) three components: an outer fabric layer 18; a lining fabric layer 25; and a middle layer 27.

Figure 2:
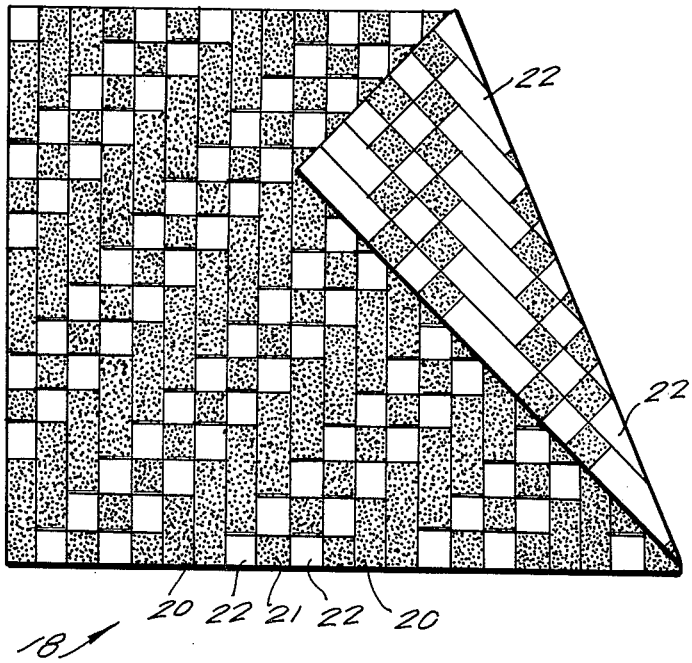
FIG. 2 is a top plan view of an exemplary outer fabric utilized in constructing fabric walls of the luggage of FIG. 1, with one corner of the fabric turned up to display the inner face of the outer fabric.

The outer fabric layer 18 according to the present invention is illustrated most clearly in FIG. 2, and comprises a fabric having a raised effect weave fabric with the raised yarn 20, 21 facing outwardly of the interior volume defined by the fabric walls 12. The raised effect weave fabric is illustrated in the drawings as a warp-faced twill weave with the warp (raised) yarn being highly abrasion resistant yarn. The term highly abrasion resistant yarn as used in the present specification and claims means CORDURA nylon fiber, polypropylene or like fibers or yarns having the same basic abrasion resistance—and preferably, strength, weight, bulk, and resistance to rot and mildew—as CORDURA. The highly abrasion resistant yarn may be of about 1000 denier, although other yarn sizes are also suitable. The fabric 18 weave includes as the ground yarn 22 (the filling yarn in the embodiment illustrated in the drawings) a spun-like yarn distinct from the raised yarn that provides textile-like aethetics to the fabric. Preferably the ground yarn is spun (low luster) polyester, with the ground yarn being a different color than the raised yarn (although preferably the colors are complimentary).

Figure 3:
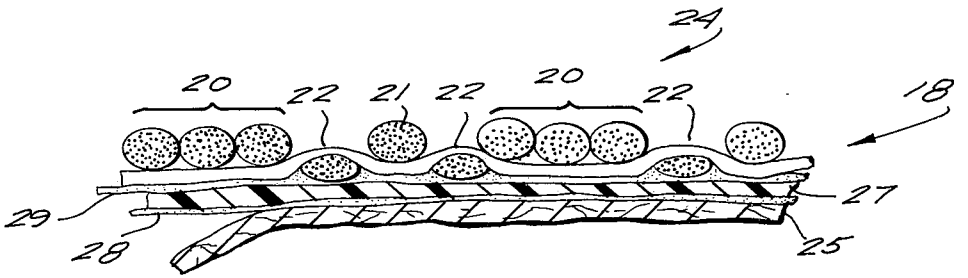
FIG. 3 is a cross-sectional view of a final fabric for producing the fabric walls in the luggage of FIG. 1.

The twill weave illustrated in the drawings has a $3_1 1_1$ construction, the warp ribs forming the "3" construction being designated by reference numeral 20 in FIGS. 2 and 3, the warp yarn having the "1" construction between the ribs 20 being illustrated at 21, and the filling yarns being illustrated at 22. (The yarns 20, 21 are the raised yarns and the yarn 22 the ground yarn.)

The lining fabric 25 preferably comprises a fabric having textile-like appearance, hand and softness, and may be dyed and/or overprinted. A nonwoven fabric eminently suited for the lining layer 25 is NEXUS fabric, whose use in luggage per se is known, the NEXUS fabric commonly being coated with vinyl. NEXUS fabric, and the method of construction thereof, are more fully described in U.S. Pat. No. 3,485,706, the disclosure of which is hereby incorporated by reference herein. The NEXUS fabric comprises textile-like nonwoven fabric comprising fibers locked into place by fiber interaction; having a repeating pattern of entangled fiber regions, of higher area density than the average area density of the fabric, and interconnecting fibers which extend between the dense entangled fiber regions and which are randomly entangled with each other in said regions; having an entangled fiber structure characterized by random fiber segments that penetrate entangled fiber regions of the fabric and have a reentrant loop configuration in the fiber segment which binds other fibers in place in the fabric; said fibers of the fabric being locked into place by a three-dimensional fiber entanglement characterized by a fiber-interlock value due to fiber entanglement of at least 7 with a fiber entanglement completeness of at least 0.5, said values being determined in the absence of binder, and wherein fibers in said regions, turn, wind, twist back and forth, and pass about one another in all directions of said regions in such an intricate entanglement that fibers interlock with one another when the fabric is subjected to stress, to thereby provide coherency and strength to the fabric.

The middle layer 27 provides means for providing a water-resistant barrier and providing desired body and laminate stiffness and dimensional stability. Preferably, the middle layer 27 preferably comprises a solid film of polymeric material, and may comprise means for attaching the outer 18 and lining 25 fabrics together, with or without adhesive. Suitable exemplary films include polyurethane film and polyvinyl chloride film with a general preferred thickness range of 1–4 mils. In FIG. 3, suitable heat-sensitive adhesives are indicated generally at 28 and 29, adhesive 28 attaching the lining 25 to the middle layer 27, and the adhesive 29 attaching the outer fabric 18 to the middle layer 27—filling the interstices therebetween—so that the textured surface character of fabric 18 is preserved in the final fabric 24.

Figure 4:
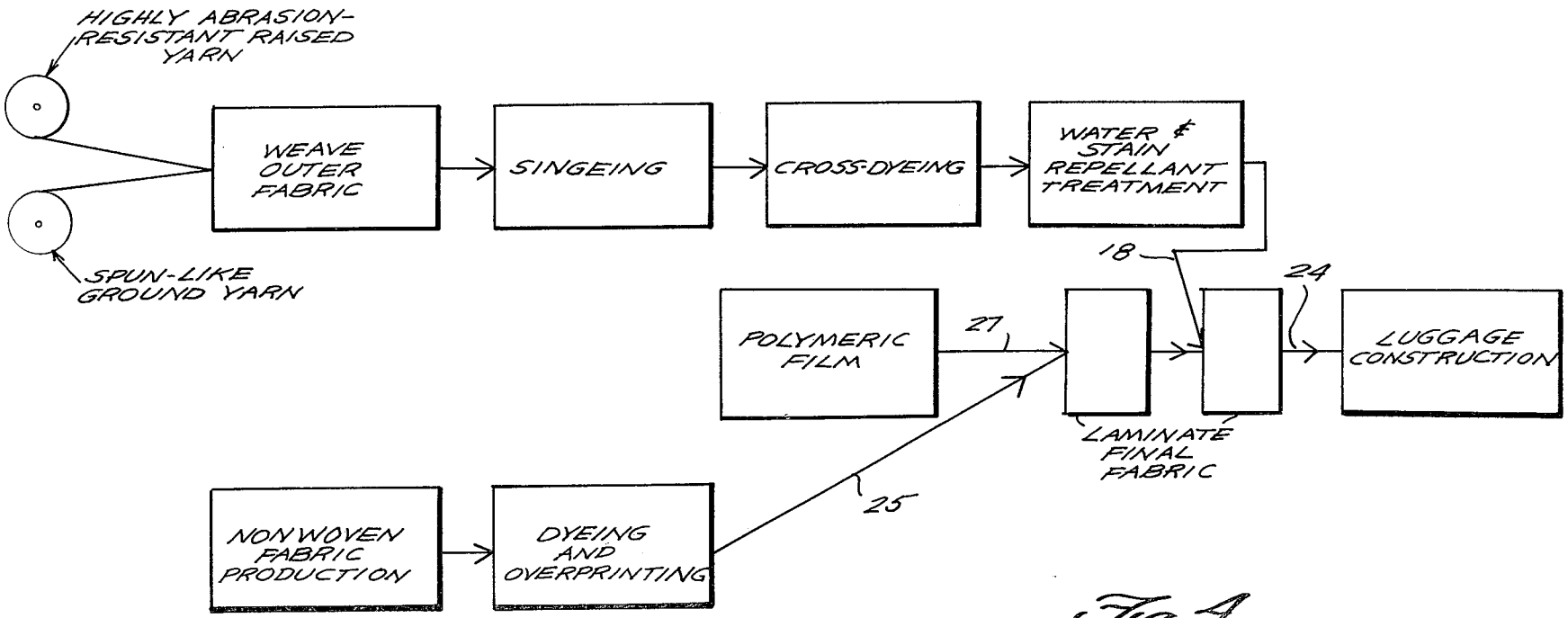
FIG. 4 is a schematic showing of exemplary process steps for practicing the method according to the invention.

FIG. 4 illustrates schematically an exemplary method for producing soft luggage 10 according to the present invention. Outer fabric 18 is produced by weaving an outer fabric having a raised effect weave with the raised yarn being highly abrasion resistant yarn and the ground yarn being a spun-like yarn, distinct from the warp yarn, which provides textile-like aesthetics to the fabric, such as spun polyester ground yarn. After weaving, the fabric is optionally cross-dyed so that the raised and ground yarns have different colors, and singed to remove loose fibers and minimize fuzzing and pilling. Then the outer fabric 18 receives a water repellent treatment. For instance it may be treated with ZEPEL water and stain repellent.

The method also comprises forming a lining fabric 25, which preferably is NEXUS. The nonwoven lining fabric is optionally dyed and overprinted. The lining fabric 25 and the outer fabric 18 are then laminated together with a solid film of water-resistant polymeric material 27 sandwiched between the layers 18, 25, with or without adhesives 28, 29, to produce the final fabric 24. The lamination may be accomplished by a combination aqueous and solvent system for adhesion process, utilizing suitable heat-sensitive adhesives, a desirable process being a proprietary process of Fabrite Laminating Corp. of Passaic, N.J. The process preferably is a two-step one. The film 27 is combined with the lining fabric 25 first utilizing adhesive 28, and then combined with the outer fabric 18 utilizing adhesive 29, as indicated in FIG. 4. The lamination process is capable of providing the necessary bond strength between the film 27 and each of the outer and lining layers 18, 25, respectively, and preserving the textured surface characteristics of fabric 18. In forming the laminate, care is taken to make sure that the raised yarn (20, 21) of the outer fabric 18 faces away from the middle layer 27.

After the fabric 24 is formed, the soft luggage 10 is constructed by conventional means, by cutting the final fabric 24 to form the luggage walls, and forming the luggage walls into a piece of luggage defining an interior volume therein, with the outer fabric 18 exterior of the interior volume defined by the fabric walls 12. The luggage 10 is completed by providing means for providing access to the interior volume within the luggage walls (e.g. zipper 14) and by providing handle means to facilitate carrying of the piece of luggage 10 (e.g. shoulder strap 16).

A piece of luggage was constructed according to the present invention utilizing 1000 denier T440 CORDURA nylon fiber as the outer fabric 18 warp (raised) yarn 20, 21 and 12/2 spun polyester as the outer fabric 18 filling (ground) yarn 22, with the outer fabric woven with a $3_1 1_1$ twill, and with a NEXUS lining and with a solid film water-resistant polyurethane film middle barrier 27, with adhesives 28, 29. The luggage 10 had a desirable appearance in general, the fabric walls 12 thereof having high abrasion resistance and being strong, tough, and durable and having a textile-like appearance and hand and three-dimensional texture, the original textured surface characteristics of fabric 18 not being adversely affected.

It will thus be seen that according to the present invention soft luggage, a method for making soft luggage, and a fabric adapted for use in the construction of soft luggage, and a highly abrasion resistant fabric in general have been provided, having all the desired attributes. While the invention has been herein shown and described in what is presently conceived to be a practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A piece of soft luggage having a plurality of highly abrasion resistant fabric walls defining an interior volume; means providing access to the interior volume; and handle means for facilitating carrying of the piece of luggage; and wherein the fabric forming the walls comprises a laminate including an outer layer, a lining layer, and a middle layer sandwiched between said outer and lining layers; and said outer layer comprising a raised effect weave having a raised yarn and a ground yarn, with highly abrasion resistant yarn providing the raised yarn, and the face thereof facing outwardly from the middle layer, and a distinct spun-like yarn providing the ground yarn.

2. A piece of soft luggage as recited in claim 1 wherein said outer layer ground yarn is low luster spun polyester.

3. A piece of soft luggage as recited in claims 1 or 2 wherein said outer layer ground yarn is of different color than said raised yarn.

4. A piece of soft luggage as recited in claim 1 wherein said middle layer comprises means for providing a water-resistant barrier and providing desired body and laminate stiffness and dimensional stability.

5. A piece of soft luggage as recited in claim 4 wherein said middle layer comprises a solid film of polymeric material.

6. A piece of soft luggage as recited in claims 1, 2, or 4 wherein said fabric forming said walls consists essentially of said outer, middle, and lining layers.

7. A piece of soft luggage as recited in claim 1 wherein said outer layer raised effect is a twill weave, and wherein said raised yarn is the warp yarn and said ground yarn the filling yarn.

8. A piece of soft luggage as recited in claim 7 wherein said twill wave is $3_1 1_1$ weave of warp and filling yarns, and wherein said warp yarn is 1000 denier high tenacity nylon.

9. A piece of soft luggage as recited in claims 1 or 2 wherein said lining layer comprises a fabric having textile-like hand, appearance and softness.

10. A piece of soft luggage as recited in claims 1 or 2 wherein said lining layer comprises a textile-like nonwoven fabric comprising fibers locked into place by fiber interaction; having a repeating pattern of entangled fiber regions, of higher area density than the average area density of the fabric, and interconnecting fibers which extend between the dense entangled fiber regions and which are randomly entangled with each other in said regions; having an entangled fiber structure characterized by random fiber segments that penetrate entangled fiber regions of the fabric; and have a reentrant loop configuration in the fiber segment which binds other fibers in place in the fabric; said fibers of the fabric being locked into place by a three-dimensional fiber entanglement characterized by a fiber-interlock value due to fiber entanglement of at least 7 with a fiber entanglement completeness of at least 0.5, said values being determined in the absence of binder, and wherein fibers in said regions turn, wind, twist back and forth, and pass about one another in all directions of said regions in such an intricate entanglement that fibers interlock with one another when the fabric is subjected to stress, to thereby provide coherency and strength to the fabric.

11. A piece of soft luggage as recited in claim 1 wherein said outer layer has a water and stain repellent treatment.

12. A piece of soft luggage having a plurality of highly abrasion resistant fabric walls defining an interior volume; means providing access to the interior volume; and handle means for facilitating carrying of the piece of luggage; and wherein the fabric forming the walls comprises a raised effect woven fabric outer layer with the raised effect facing outwardly of the interior volume, and including a raised yarn and a ground yarn with highly abrasion resistant yarn providing the raised yarn and a spun-like yarn, distinct from the raised yarn and which provides a textile-like tactility and appearance to the fabric, providing the ground yarn; a lining; and means for providing a water-resistant barrier and providing desired body and stiffness and dimensional stability.

13. A piece of soft luggage as recited in claim 12 wherein said fabric outer layer raised effect weave comprises a twill weave.

14. A piece of soft luggage as recited in claim 13 wherein the means for providing a water-resistant barrier and providing desired stiffness and dimensional stability comprises a solid film of polymeric material laminating said outer layer and said lining together.

15. A piece of soft luggage as recited in claim 12 wherein said fabric forming said walls consists essentially of said outer layer, solid film of polymeric material, and lining.

16. A piece of soft luggage as recited in claim 12 wherein said ground yarn is spun yarn having a different color than said raised yarn.

17. A piece of soft luggage as recited in claims, 1,2,13, 14, 15, or 16 wherein said lining comprises a fabric having textile-like hand, appearance and softness.

18. A fabric suitable for use in the construction of soft luggage or the like, and comprising an outer layer fabric comprising a raised effect weave including a raised yarn and a ground yarn, with highly abrasion resistant yarn providing the raised yarn, and a distinct spun-like yarn providing the filling yarn, which provides textile-like aesthetics to the fabric; a lining layer comprising a fabric having textile-like appearance, hand and softness characteristics; and a water-resistant barrier between said lining and outer layers.

19. A fabric as recited in claim 18 wherein said water-resistant barrier comprises means for providing desired body and stiffness and dimensional stability to the fabric.

20. A fabric as recited in claim 19 wherein said water-resistant barrier comprises a film of polymeric material laminated to said outer and lining layers.

21. A fabric as recited in claims 18, 19 or 20 wherein said lining layer fabric comprises a nonwoven fabric having fibers locked into place by fiber interaction; having a repeating pattern of entangled fiber regions, of higher area density than the average area density of the fabric, and interconnecting fibers which extend between the dense entangled fiber regions and which are randomly entangled with each other in said regions; having an entangled fiber structure characterized by random fiber segments that penetrate entangled fiber regions of the fabric; and have a reentrant loop configuration in the fiber segment which binds other fibers in place in the fabric; said fibers of the fabric being locked into place by a three-dimensional fiber entanglement characterized by a fiber-interlock value due to fiber entanglement of at least 7 with a fiber entanglement completeness of at least 0.5, said values being determined in the absence of binder, and wherein fibers in said regions turn, wind, twist back and forth, and pass about one another in all directions of said regions in such an intricate entanglement that fibers interlock with one another when the fabric is subjected to stress, to thereby provide coherency and strength to the fabric.

22. A fabric suitable for use in the construction of soft luggage or the like, and comprising an outer layer fabric comprising a raised effect weave; a lining layer comprising a fabric having textile-like appearance, hand and softness characteristics; and a water-resistant barrier between said lining and outer layers; wherein said lining layer fabric comprises a nonwoven fabric having fibers locked into place by fiber interaction; having a repeating pattern of entangled fiber regions, of higher area density than the average area density of the fabric, and interconnecting fibers which extend between the dense entangled fiber regions and which are randomly entangled with each other in said regions; having an entangled fiber structure characterized by random fiber segments that penetrate entangled fiber regions of the fabric; and have a reentrant loop configuration in the fiber segment which binds other fibers in place in the fabric; said fibers of the fabric being locked into place by a three-dimensional fiber entanglement characterized by a fiber-interlock value due to fiber entanglement of at least 7 with a fiber entanglement completeness of at least 0.5, said values being determined in the absence of binder, and wherein fibers in said regions turn, wind, twist back and forth, and pass about one another in all directions of said regions in such an intricate entanglement that fibers interlock with one another when the fabric is subjected to stress, to thereby provide coherency and strength to the fabric.

23. A fabric as recited in claim 22 wherein said water-resistant barrier comprises means for providing desired body and stiffness and dimensional stability to the fabric.

24. A fabric as recited in claim 23 wherein said water-resistant barrier comprises a film of polymeric material laminated to said outer and lining layers.

* * * * *